US005746457A

United States Patent [19]

Kim

[11] Patent Number: 5,746,457

[45] Date of Patent: May 5, 1998

[54] LOCKING DEVICE

[75] Inventor: Manyeob Kim, Incheon, Rep. of Korea

[73] Assignee: Dongyang Mechatronics Corp., Incheon, Rep. of Korea

[21] Appl. No.: 807,436

[22] Filed: Feb. 28, 1997

[30] Foreign Application Priority Data

Oct. 28, 1996 [KR] Rep. of Korea ..... 1996 48967

[51] Int. Cl.[6] ..... E05C 3/16; E05B 9/06

[52] U.S. Cl. ..... 292/216; 292/DIG. 23; 292/DIG. 53; 292/337

[58] Field of Search ..... 292/216, DIG. 23, 292/DIG. 53, DIG. 64, 337; 411/107, 383, 396

[56] References Cited

U.S. PATENT DOCUMENTS

| | | | |
|---|---|---|---|
| 3,170,722 | 2/1965 | Schutte | 292/216 X |
| 3,858,916 | 1/1975 | Torii et al. | 292/DIG. 23 |
| 4,756,563 | 7/1988 | Garwood et al. | 292/216 |
| 4,773,683 | 9/1988 | Nakamura | 292/216 |
| 4,838,588 | 6/1989 | Hayakawa et al. | 292/216 |
| 5,069,491 | 12/1991 | Weinerman et al. | 292/216 X |
| 5,288,115 | 2/1994 | Inoue et al. | 292/216 X |
| 5,474,339 | 12/1995 | Johnson | 292/216 |
| 5,538,150 | 7/1996 | Perkins | 292/216 X |

*Primary Examiner*—Rodney M. Lindsey
*Assistant Examiner*—Robert G. Santos
*Attorney, Agent, or Firm*—Morgan & Finnegan LLP

[57] ABSTRACT

The present invention discloses an improved locking device for a vehicle's trunk, door and seat which is simple in structure with a minimized number of parts, assembly steps and likelihood of deformation caused by weight pressure. This locking device includes shafts, each having a large diameter portion at its middle part and a small diameter portion at both ends thereof. The small diameter portions have a smaller diameter than the large diameter portions. The locking device also includes a latch and a pawl revolvably combined on each of the shafts. The shafts are used to affix the whole device to a vehicle body.

3 Claims, 4 Drawing Sheets

LOCKING DEVICE

BACKGROUND OF THE INVENTION

The present invention relates to a locking device to lock a trunk, doors or seat of a vehicle, particularly a locking device improved to be manufactured by a simplified assembly process with a remarkably smaller number of parts.

As shown in FIG. 1 and 2, a general locking device for a vehicle's trunk, doors and seats comprises upper and lower plates(10, 20) in a certain distance, a latch(41) and a pawl(42) interlocked between the upper and the lower plates(10)(20) and hollow shafts(1)(2) with both ends respectively rivetted to the upper and the lower plates so that they axially support the latch(41) and the pawl(42).

The latch(41) and the pawl(42) are linked by a spring(7) so as to be elastically biased. The interlocked latch(41) and pawl(42) lock to a locking pin(not shown). A release rod(8) is connected to the pawl(42). When the release rod(8) is manually operated, the latch(41) revolves and the locking device is released. Reference numbers 3 to 6 are washers.

This general locking device has some problems. It requires rivetting both ends of the shaft(1)(2) to fix the upper and the lower plate(10)(20) and further needs bolts(51)(52) and nuts(53)(54) for fastening. Consequently, a corresponding number of steps and parts is required in assembling the locking device. In addition, errors in manufacturing and assembling the hollow shafts(1)(2) and fastening bolts(51)(52) cause the shafts (1)(2) to rock in relation to the fastening bolts(51)(52) resulting in oscillation which shortens the life of the bolts(51)(52).

SUMMARY OF THE INVENTION

It is an object of the present invention to provide a locking device which remarkably limits' the number of required parts and assembling steps.

It is another object of the present invention to improve the structure of a locking device to minimize deformation caused by weight pressure in a collision, for example, and to extend the life of the device.

To achieve the above objects of the present invention, there is provided a locking device comprising at least a couple of shafts each having a middle part with a larger diameter than that of both ends, one of which has screw;

- a lower plate having screw holes to each of which one end of each shaft with screw is screw-jointed;
- an upper plate having holes to each of which the other end of each shaft is connected;
- a latch and a pawl interlocked and revolvably combined with large diameter portion of the respective shafts so that they lock to or release from a locking pin fixed to a fixing portion; and
- a releasing means for releasing the latch from the locking pin;
- wherein one end of each shaft is screw-jointed to the fixing portion while the other end is rivetted to the upper plate.

Here, it is desirable that a groove is formed at the rivetted end of the shaft so that the shaft can be easily released from the fixing portion or the lower plate. It is further desirable that a groove is formed at the end of the shafts before rivetting so that tools like a screw drive can be used for easily assembling the shafts with fixing portion or the lower plate.

The releasing means comprises a spring which makes the latch and pawl elastically biased, and a releasing rod which revolves the latch or the pawl.

According to aforesaid characteristics, the locking device of the present invention enables a couple of shafts to revolvably support the latch and the pawl and, at the same time, to fix the whole device to the fixing portion so that the structure of the device is simplified by reducing the number of required parts and steps in assembly and suppress oscillation and minimizes possible deformation from weight pressure to extend the life of the device.

BRIEF DESCRIPTION OF THE DRAWINGS

FIG. 3 is a dissolved perspective view of a locking device according to an aspect of;

DESCRIPTION OF THE PREFERRED EMBODIMENT

Figure 1:
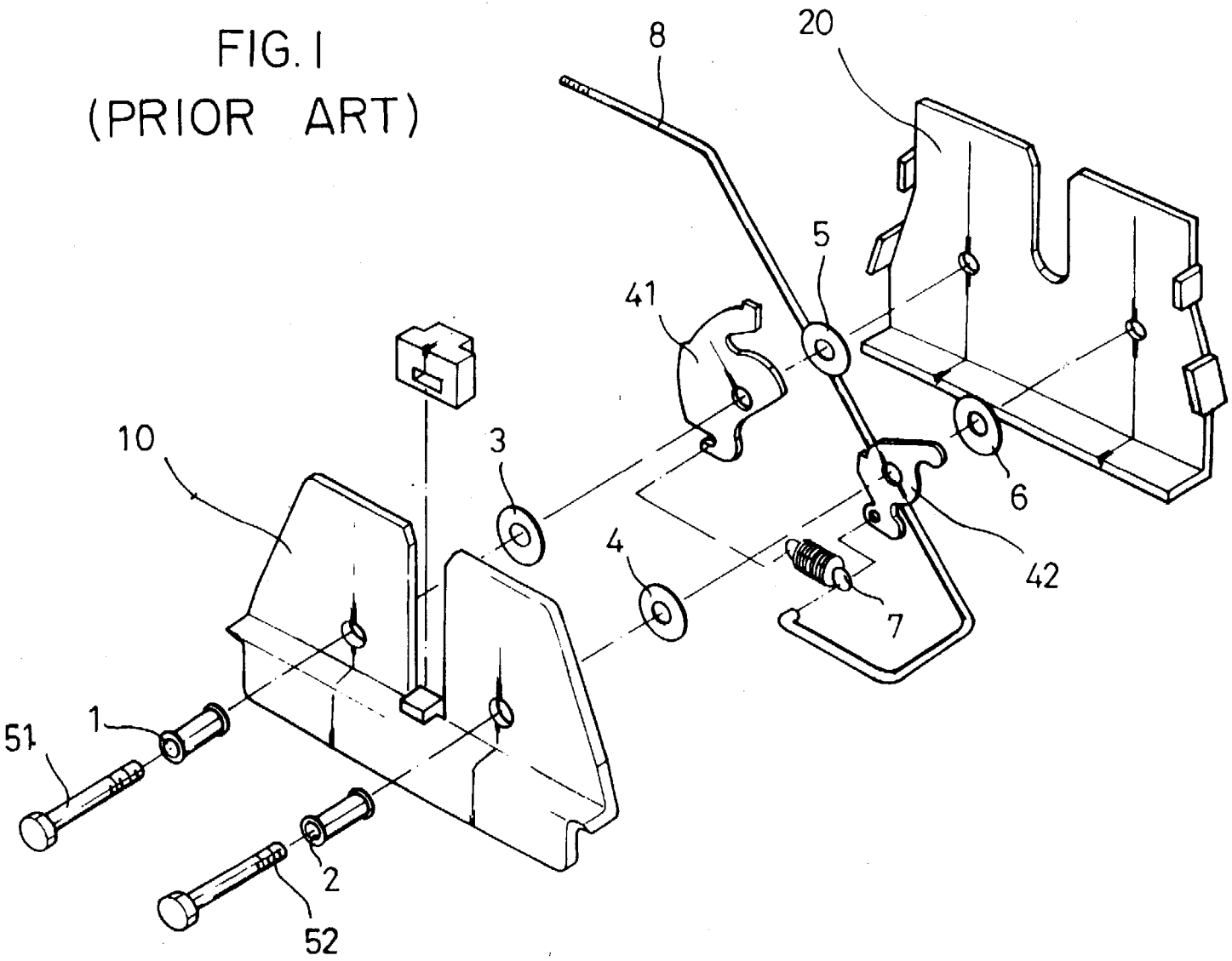
FIG. 1 (PRIOR ART)
FIG. 1 is a dissolved perspective view of a prior art locking device.
Figure 2:
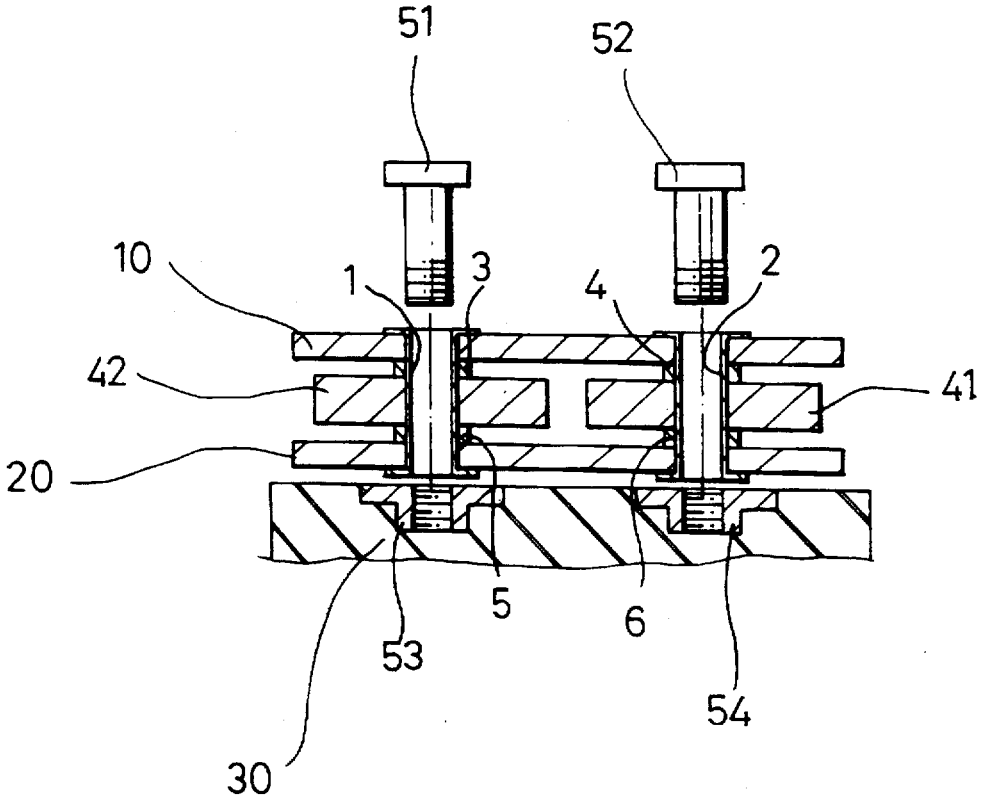
FIG. 2 (PRIOR ART)
FIG. 2 is a cross sectional view of the assembled prior art locking devices shown in FIG. 1.
Figure 3:
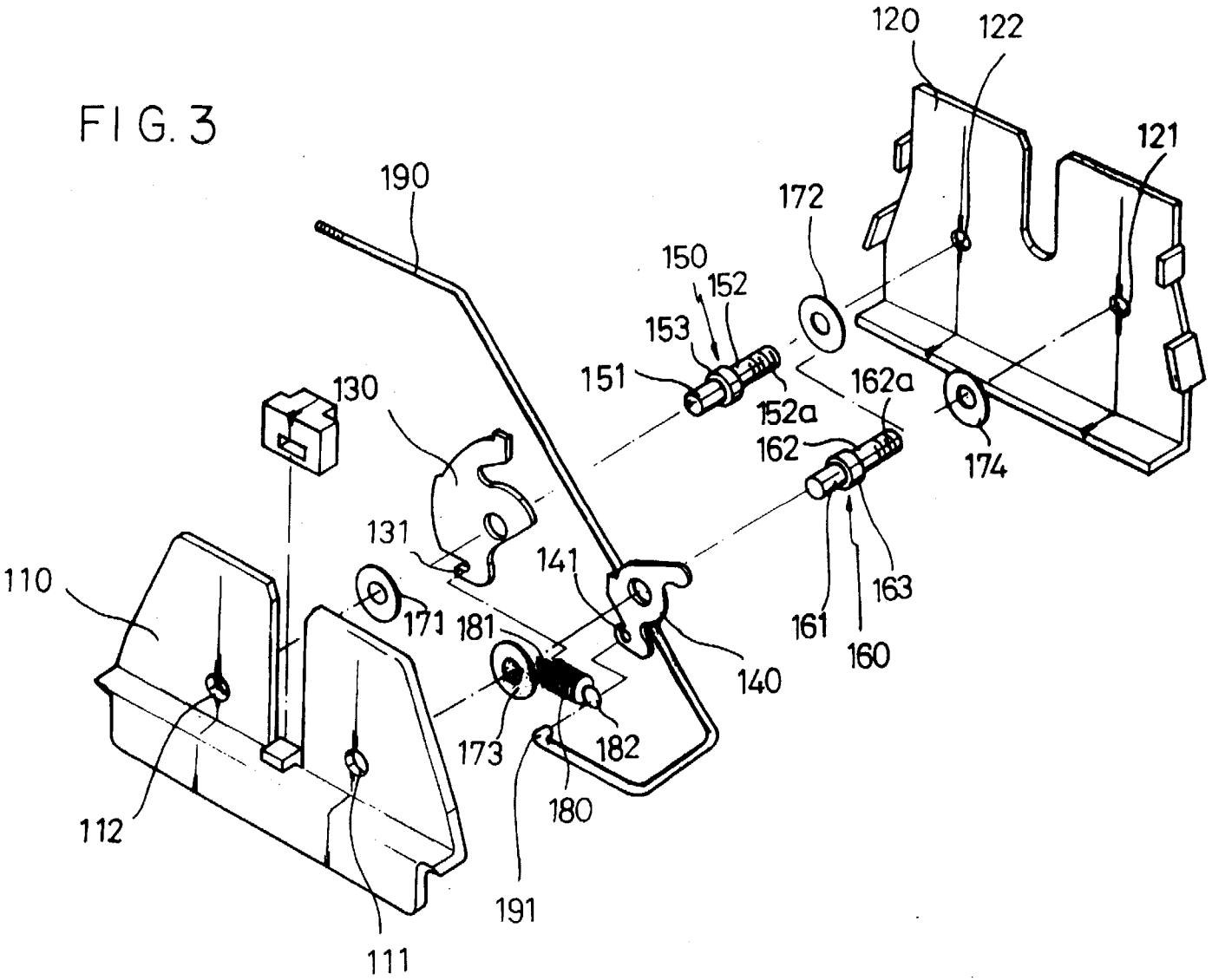
Figure 4:
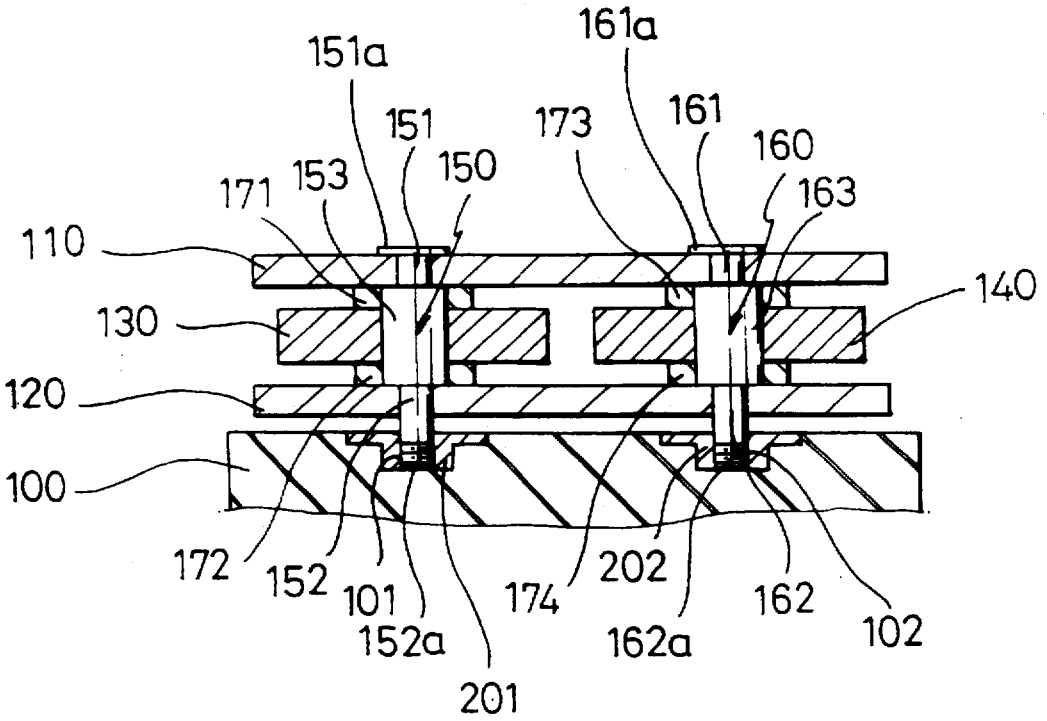
FIG. 4 is a cross sectional view of the assembled locking device according to an aspect of the present invention.

Referring to FIGS. 3 and 4, a locking device according to the current invention is similar to the prior art in the required parts. The present invention comprises a latch(130) and pawl(140) rotatably interlocked between and lower plates (110)(120), a pair of shafts(150)(160) which rotatably support the latch(130) and pawl(140), a spring(180) which rotatably links the latch(130) and pawl(140) and releasing rod(190) which rotates the pawl(140).

The shafts(150)(160) have large diameter portions(153, 163) at the middle of their respective bodies. Small diameter portions(151,152) (161,162) having a diameter that is smaller than the large diameter portion are formed at both ends of each shaft. Screws(152*a*)(162*a*) are formed at one end of the small diameter portions' (152)(162). Screw holes(121)(122) are made on the lower plate(120) for receiving the screwed ends of the small diameter portions. Penetration holes(111)(112) are formed on the upper plate(110) for accepting the other end of the small diameter portion (151)(161) of each shaft(150)(160). Reference numbers 201, 202 are nuts to be screw-jointed with screws(152)(162*a*) of the small diameter portions(152)(162).

The locking device of the present invention is assembled in a way described below.

After washers(172)(174) are inserted on the small diameter portions(152)(162) of respective shafts(150)(160), the screws(152*a*)(162*a*) are inserted into the screw holes(121) (122) of the lower plate(120).

Then, the latch(130) and pawl(140) are combined on each large diameter portions(153)(163) of respective shafts(150) (160) and washers(171)(173) are assembled on the respective small diameter portions(151)(161). Thereafter, a loop (181) of the spring(180) is hung on hook(131) of the latch(130) and the other loop(182) of the spring(180) is connected to the keeping portion(191) of the releasing rod(190) which is then inserted into the accepting hole(141) of the pawl(140). Then the small diameter portion(151)(161) of the shafts(150)(160) are inserted into the penetration holes(111)(112) of the upper plate(110). After this, the projecting parts of the small diameter portions(151)(161) are rivetted to form rivet heads(151*a*)(161*a*).

It is desirable that a groove (not shown) is formed on the top of the small diameter portions(151)(161) of the shafts (150)(160) so that a handy tool like a screw driver can be used for tightening the assembled elements to the lower plate(120) or disassembling them by turning the shafts(150)(160). It is further desirable that a groove is formed at the end of the shafts before rivetting so that tools like a screw driver can be used for easily assembling the shafts to a fixing portion or to the lower plate(120). The aforesaid locking device is assembled to a portion such as a vehicle's body (100) by inserting screw portions(152*a*)(162*a*) into assembly holes of the body(100) and revolving nuts(201)(202) for fastening.

The locking device according to the present invention has the following advantages.

Firstly, it provides more simplified structure with less parts and assembling steps since shafts(150)(160) revolvably support the latch(130) and pawl(140) and simultaneously fix the whole device to the vehicle's body(100).

Secondly, it extends the life time of the device by restraining oscillation possibly caused by errors in the manufacturing and assembly for the parts.

Thirdly, it prevents deformation of the device caused by weight pressure by minimizing the distance between the shafts(150)(160) and the locking pin(not shown) to which the latch(130) and the pawl(140) lock.

It is apparent that the present invention is not limited to the embodiment described above but modification and changes can be possible within the scope of the present invention as defined by the appended claims.

What we claim is:

1. A locking device comprising a pair of shafts, each shaft having a middle part and first and second end parts, said middle part having a first diameter and said first and second end parts, having a second diameter, said second diameter being smaller than said first diameter said second end part having a screw portion;

a lower plate having a pair of screw holes for receiving said second end parts of said shafts;

an upper plate having a pair of holes for accepting said first end parts of said shafts;

a latch and a pawl interlocked to each other, said latch and said pawl being rotatably affixed to said middle part of respective ones of said shaft; and a releasing means for rotating said latch;

wherein said second end portion of each of said shafts is screw-jointed to a fixing portion while said first end portion of each of shafts is riveted to said upper plate.

2. A locking device as claimed in claim 1, wherein a groove is formed at an end of said first end portion of each of said shafts.

3. A locking device as claimed in claim 1 or 2, wherein said releasing means comprises a spring for elastically biasing said latch and said pawl and a releasing rod coupled to said pawl for rotating said pawl.

* * * * *

UNITED STATES PATENT AND TRADEMARK OFFICE

CERTIFICATE OF CORRECTION

PATENT NO. : 5,746,457

DATED : May 5, 1998

INVENTOR(S) : Manyeob Kim

It is certified that error appears in the above-indentified patent and that said Letters Patent is hereby corrected as shown below:

Col. 1, line 34, change "limits'" to --limits--.

Col. 2, line 15, change "devices" to --device--.

Col. 2, line 17, change "of;" to --of the present invention--.

Col. 2, line 26, after "between" insert --upper--.

Col. 2 line 29, change "rotatably" to --elastically--.

Col. 2, line 36, change "portions'" to --portions--.

Col. 3, line 6, after "a", first occurrence, insert --fixing--.

Col. 3, line 17-18, change "manufacturing" to --manufacture--.

Col. 3, line 18, change "for" to --of--.

Col. 4, line 5, change "parts," to --parts--.

Col. 4, line 6, after "diameter" insert --,--.

Signed and Sealed this

Eighteenth Day of August, 1998

Bruce Lehman

*Attest:*

BRUCE LEHMAN

*Attesting Officer*

*Commissioner of Patents and Trademarks*